United States Patent [19]

Arthur et al.

[11] Patent Number: 4,665,930

[45] Date of Patent: May 19, 1987

[54] MANUFACTURE OF VENTILATED CIGARETTES

[75] Inventors: Hugh M. Arthur, High Wycombe; John A. Mills, London; Godfrey A. Wood, High Wycombe, all of England

[73] Assignee: Molins plc, Great Britain

[21] Appl. No.: 655,440

[22] Filed: Sep. 28, 1984

[30] Foreign Application Priority Data

Sep. 30, 1983 [GB] United Kingdom ..... 8326255

[51] Int. Cl.[4] ..... A24C 5/60

[52] U.S. Cl. ..... 131/281; 131/96

[58] Field of Search ..... 131/281, 96

[56] References Cited

U.S. PATENT DOCUMENTS 4,188,847 2/1980 Payne ..... 131/281

*Primary Examiner*—V. Millin

*Attorney, Agent, or Firm*—Antonelli, Terry & Wands

[57] ABSTRACT

Cigarettes are perforated by being rolled along a row of pins which are excited, for example by being vibrated. Vibration may be towards and away from the cigarettes so that the pins penetrate as a result of the vibration; the depth of penetration may be varied to control the size of the perforations. Alternatively the vibration may be in a direction transverse to the axes of the pins. In either case the pins may be mounted on a flexible member having a resonant frequency equal to the frequency of vibration. The vibratorary drive may be an electro magnetic device or a piexoelectric crystal. An alternative form of excitation of the pins involves passing compressed air through the pins and into the cigarettes, the pins being tubular for that purpose.

11 Claims, 7 Drawing Figures

MANUFACTURE OF VENTILATED CIGARETTES

According to this invention, a method of perforating cigarettes comprises rolling the cirgarettes with respect to a set of pins and exciting the pins to promote their penetration through the wrappers of the cigarettes.

The excitation of the pins may involve vibratrion of the pins. Alternatively, the pins may be excited by the passage through them of compressed gas which blows into the cigarette and thus assists in the formation of the perforations.

One preferred cigarette perforating device according to this invention comprises means for rolling a succession of sideways-moving cigarettes along a perforating member which is vibrated, preferably in a direction towards and away from the cigarettes, and carries at least one row of pins extending in the direction of movement of the cigarettes, the pins being arranged to project towards the cigarettes and to perforate the cigarettes at least while the perforating member is being reciprocated.

Perforation of the cigarettes as they roll past the perforating member may occur as a result of the vibratory motion of the perforating member; that is to say, when the perforating member is at rest (i.e. not vibrating) the tips of the pins lie slightly clear of the cigarettes. Alternatively the positions of the pins while at rest may be such that the tips of the pins do engage the surfaces of the cigarettes of the cigarettes as they roll past the perforating member, though the force with which such engagement takes place may be insufficient to penetrate the wrappers of the cigarettes.

Perforation by means of the preferred vibratory perforator is at least to some extent based for its effect upon the impact of the pins on the cigarettes resulting from the vibration of the perforating member. Cigarettes can be perforated by being rolled over fixed pins (for example as described in our British Pat. No. 1564219), but without the impact provided by the preferred vibratory perforator according to the present invention there is a tendency for the pins, at least initally, merely to deform the surface of the cigarette without actually penetrating it. In order to ensure that penetration occurs, a relatively large degree of interference between the cigarettes and the pins is needed, which results in the pins entering deeply cigarettes and tending to tear the cigarette wrapper as the cigarette rolls off the pins.

With the present invention, on the other hand, the impact of the pins on the cigarettes results in more rapid penetration so that the final penetration need not be so deep, and cleaner holes are consequently formed. Moreover, the depth of penetration can be controlled to vary the size of the holes, assuming that the pins taper to a point; this control may be achieved by altering the amplitude of the vibration and/or by altering the mean positions of the pins.

The cigarettes are preferably rolled as a result of being conveyed between a moving member, for example a drum, and a fixed rolling member, the perforating member being vibrated with respect to the fixed rolling member. As an alternative, however, the cigarettes may be rolled as a result of cooperation betwen a conveyor such as a drum and the pins on the perforating member itself. A further alternative is that each cigarette may be carried in a smooth flute in which it spins while rolling with respect to the pins on the perforating member.

The frequency at which the perforating member is vibrated is not believed to be critical. However, the perforating member preferably moves towards and away from the cigarette at least once for each perforation to be formed in a given circumferentially extending row of perforations around the cigarette. For example, if the or each row of perforations around the cigarette comprises 25 perforations and if the cigarettes move past the perforator at a rate of 4,000 per minute then the vibration may be at a frequency of $25 \times 4{,}000$ cycles per minute or 1666 cycles per second or higher. Alternatively, if the cigarette is compressed by the folling operation so that, for example, two pins at the same time perforate the cigarette wrapper, then the frequency of vibration may be halved.

Preferably the perforating member is vibrated by means of an electro-magnet powered by an alternating potential. The arrangement may be similar in principle to a loudspeaker drive. The perforating member is preferably mounted on a flexible member such as a leaf spring extending at right angles to the direction of movement of the perforating member to restrain the perforating member against sideways movement; this flexible member may be arrangd to have a resonant frequency equal to the frequency of vibration to minimise the power required to vibrate the perforating member.

Compared with our earlier British Pat. No. 2018568, the present invention has certain advantages, particularly in regard to its greater simplicity and adaptability.

In an alternative form of cigarette perforating device according to this invention, the vibration of the pins is in a direction transverse to the axes of the pins, for example in the direction of movement of the cigarettes or in a direction substantially parallel to the axes of the cigarettes.

The vibration in this case can be regarded as a means of "lubricating" the passage of the pins through the cigarette wrappers. It preferably occurs at a frequency substantially higher than the frequency at which holes are formed in each cigarette. For example, the vibration frequency may be of the order of 10000 to 21000 cycles per second or may be even higher and possibly ultrasonic. For that purpose, the vibratory drive may be provided by a crystal through a piezoelectric effect.

This invention lends itself to incorporation in a filter attachment machine in the area in which portions of uniting paper are wrapped around cigarettes and filters to form filter cigarettes by a rolling action. However, perforation of cigarettes in accordance with this invention may be carried out at a later stage, for example by rolling cigarettes backwards in flutes of a carrier drum, each cigarette being initially carried at one circumferential extremity of a flute and being rolled backwards to the other circumferential extremity while being perforated. Alternatively, the overall construction of the perforating device, apart from provision for the desired vibration of the pins, may be as described in our British Pat. No. 1564219.

According to yet another aspect of this invention, a cigarette perforating device comprises means for rolling cigarettes over at least one row of tubular pins arranged to communicate with a source of gas pressure whereby gas blows through the pins and into the cigarettes.

Examples of perforating devices according to this invention are shown in the accompanying drawings. In these drawings.

Figure 1:
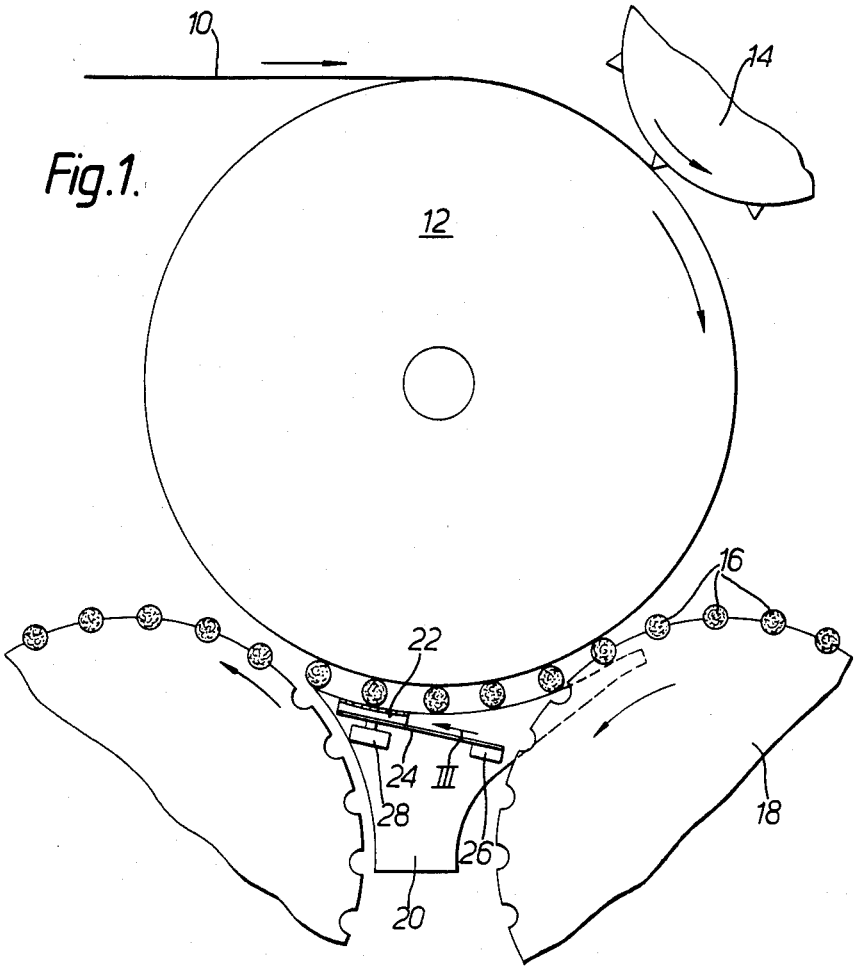
FIG. 1 is a diagrammatic illustration of part of a filter attachment machine including a perforating device.

FIG. 1 shows part of a filter attachment machine in which a web of uniting paper or "cork" 10 is fed tangentially towards a rolling drum 12 and is cut at regular intervals by a rotating knife 14 in a well known manner used in the Molins PA8 filter attachment machine. As a result, spaced portions of the uniting paper are conveyed with the aid of suction on the surface of the drum 12 to a position at which they meet successive cigarette/filter assemblies 16 carried by a fluted drum 18. Each assembly 16 consists of two axially aligned cigarette portions with an interposed double filter portion. During its passage between the drum 12 and a rolling plate 20, each assembly 16 is rolled through a number or revolutions so as to wrap a portion of uniting paper around it to form a double filter cigarette in a conventional manner (see also FIG. 3).

During its last roll, each assembly 16 moves along a perforating member 22 which is mounted on one end of a pair of parallel flexible members 24 which are rigidly mounted at their other end on a member 26 secured in the rolling plate 20. An electro magnetic drive arrangement 28 causes the perforating member 22 to vibrate towards and away from the cigarette assemblies so that pins 30 on the perforating member 22 form the desired rows of perforations 32 in the cigarette assembly.

Figure 3:
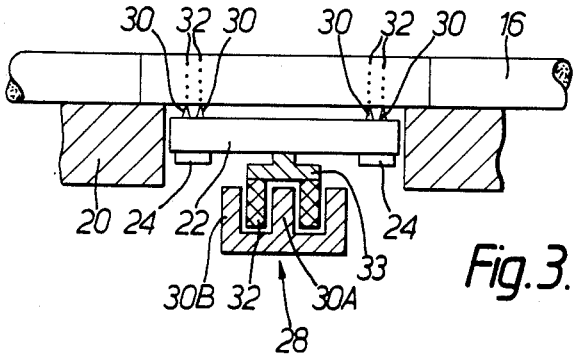
FIG. 3 is an enlarged sectional view of the perforating device in the direction of the arrow III.

As shown more clearly in FIG. 3, the perforating member 22 carries two pairs of rows of pins 30 so as to form four rows of perforations 32. When each assembly is cut in half to form two individual filter cigarettes, it will be appreciated that each filter cigarette will have two circumferentially extending rows of perforations 32.

Figure 2:
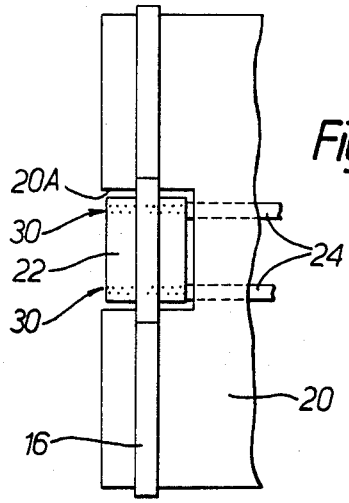
FIG. 2 is a plan view of the perforating device with certain parts of the machine removed.

As shown particularly in FIG. 2 (FIG. 1 being somewhat diagrammatic), the rolling plate 20 has a cut out portion 20A to accommodate the perforation member 22. In addition, the rolling plate 20 is formed with appropriate recesses to accommodate the flexible members 24 and mounting member 26.

In order to vibrate the perforating member 22, the electro magnetic drive 28 comprises a fixed permanent magnet consisting of a centre part 30A and an outer annulus 30B of opposite polarity. Between those parts of the magnet, with running clearance, there is a coaxial coil 32 which is supplied with an alternating current to produce the desired vibratory drive, the coil 32 being carried by a part 33 which engages or is secured to the perforating member 22. A proprietory electro-magnetic drive which may be used for this purpose is the Type GWV2 vibrator made by Gearing & Watson (Electronics) Ltd.

Figure 4:
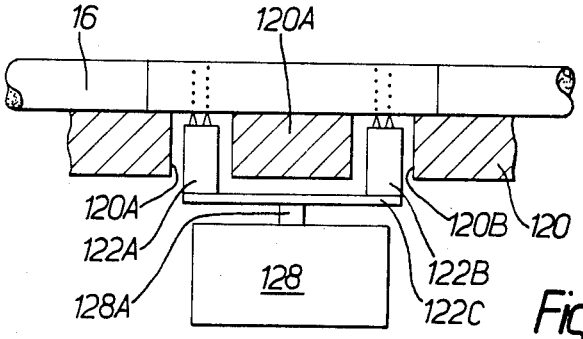
FIG. 4 is a view similar to FIG. 3 of a modified arrangement.

FIG. 4 shows a modified arrangement in which a rolling plate 120 has two relatively narrow recesses 120A and 120B to accommodate two laterally spaced parts 122A and 122B of a perforating member, leaving intact a central part 120A of the rolling plate. The parts 122A and 122B carry pins, as before, and are themselves carried by a beam 122C parallel to the cigarette 16. The beam 122C is centrally mounted on the moving part 128A of a vibratory drive 128.

There may in addition be one or more leaf springs like the springs 24 in FIGS. 1 to 3, and/or leaf springs parallel to the cigarette, to locate the perforating member in directions transverse to its direction of vibratory motion. Alternatively, or in addition, a suitable suspension for that purpose may be incorporated in the vibratory drive 128.

In order to amplify mechanically the motion of the pin-carrying parts 122A, 122B, the beam 122C may be flexible so that each end vibrates with respect to the centre of the beam at a resonant frequency equal to the frequency of vibration of the drive 128.

A further alternative is that each of the pin-carrying parts 122A and 122B shown in FIG. 4 (possibly including leaf springs as described) may have a separate electro-magnetic or other vibratory drive, each part 122A, 122B being possibly mounted directly on its own separate respective vibratory device. In the event of the vibration being of high frequency and low amplitude, it will be understood that the mean positions of the pin-carrying parts 122A, 122B would be closer to the cigarette than is shown in FIG. 4, so that the pins extend into the cigarette wrapper; the direction of vibration may in this case be transverse to the axes of the pins.

Figure 5:
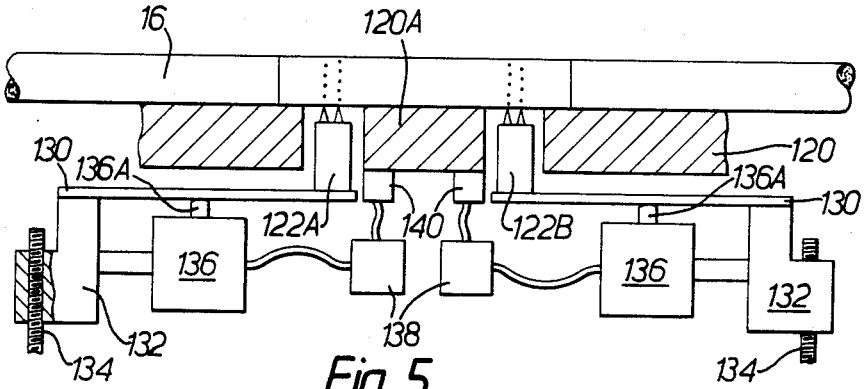
FIG. 5 shows another modification.

FIG. 5 shows a modification of FIG. 4 in which identical parts are identically referenced and will not be described again. Each pin-carrying part 122A, 122B in this instance is carried by a separate spring beam 130 which, in order to achieve a desired resonance characteristic, may taper in plan view towards the end on which the part 122A or 122B is mounted, so as to be approximately triangular in shape. At its other end each spring beam 130 is mounted on a vertically adjustable block 132.

Vertical adjustment is achieved by rotating a screw-threaded jack member 134 to vary the size of the holes formed in the cigarette by the pins. Also mounted on each block 132 is a vibratory drive 136 having a vibratory part 136A which engages the spring beam 130 at a position between its ends.

Each vibratory unit 136 has an associated power supply 138 which provides an A.C. supply to the vibratory unit at a frequency corresponding to the resonant frequency of the spring beam. For that purpose a pick-up transducer 140 close to the vibrating end of the spring beam provides an alternating signal to the power supply 138, and the frequency and phase of the output from the power supply are automatically adjusted so as to maintain the spring beam in a resonantly vibrating condition.

In each of the above examples, the pins may each have conical or tapered end portions with an especially sharped point (i.e. with a narrower included angle). Alternatively, the end portions of the pins may be "hollow ground" so as to have a concave outline in a longitudinal section, again to provide an especially sharped point for initially penetrating the cigarette wrapper. In cross-section the ends portions may be circular or rectangular or any other shape so as to form correspondingly shaped perforations.

Figure 6:
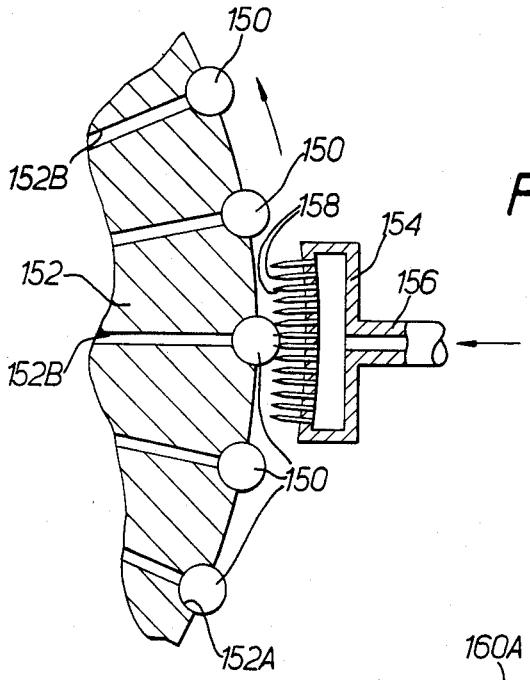
FIG. 6 shows diagramatically a different form of perforating device using tubular pins excited by compressed air.

FIG. 6 shows a different form of perforating device in which cigarettes 150 are carried by a fluted drum 152 past a perforating member 154 which is hollow and is supplied with compressed air through a pipe 156. Tubular pins 158 extend towards the drum from a concave surface of the member 154, being radial with respect to the drum. The internal bores of the pins 150 communicate with the source of compressed air within the member 154.

Each cigarette 150 is carried in a polished flute 152A. Before reaching the perforating member 154, and after passing that member, each cigarette is held in the flute by suction applied through radial passages 152B in the drum 152. A valve within the drum (of any known construction) causes suction to cease while each cigarette is being perforated, so that the cigarette is free to spin in its flute while rolling with respect to the pins. While each cigarette is spinning, compressed air may be supplied to the corresponding passages 152B to provide an air bearing effect.

Figure 7:
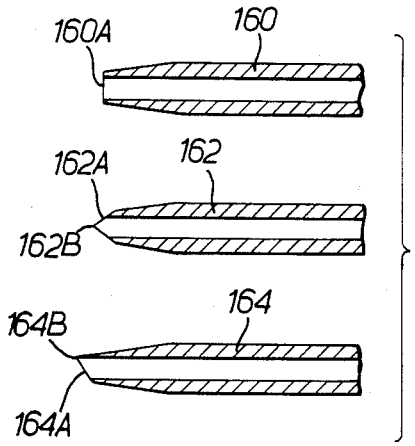
FIG. 7 shows, on a larger scale, different shapes of tubular pins which may be used in the apparatus shown in FIG. 6.

FIG. 7 shows three possible pin shapes. The pin 160 has a squarely machined tip 160A. In contrast, the tip 162A of the pin 162 has two flat machined surfaces producing a pair of points 162B as shown in FIG. 7. Finally, the pin 164 has an oblique end face 164A forming a point 164B on one side of the pin, this being for example the side which first penetrates the cigarette wrapper.

By way of example, the tubular pins may be similar to hypodermic syringe needles. For example, each pin may have an outside diameter of 20 thousandths of an inch (approximately 0.508 mm) and an internal bore with a diameter of 8 thousandths of an inch (approximately 0.2 mm). The air pressure may be in the region of 40–60 pounds per square inch (approximately 275800 to 413700 Pascal). The pins may be arranged to penetrate through the cigarette wrappers by approximately 1.5 to 2 mm.

In general in the case of tubular pins fed with compressed air, the tips of the pins as they penetrate the cigarette wrappers may partially shear the wrapper material around the aperatures to form, at each aperature, one or more tabs which are pushed into the cigarette by the action of the pins with the assistance of the compressed air. The continued ejection of air as each pin is withdrawn from the wrapper helps to ensure that the tab remains in the cigarette, instead of partially withdrawing to re-close the aperature.

The use of tubular pins with compressed air may be combined with vibration if so desired.

We claim:

1. A method of perforating cigarettes comprising rolling the cigarettes with respect to a set of pins and vibrating the pins to promote their penetration through the wrappers of the cigarettes, said pins being vibrated at a frequency which is substantially higher than the frequency at which holes are formed in each cigarette.

2. A method of perforating cigarettes comprising rolling the cigarettes with respect to a set of pins and exciting the pins to promote their penetration through the wrappers of the cigarettes, in which the pins are tubular and the excitation of the pins comprises passing compressed gas through the pins and into the cigarettes.

3. A cigarette perforating device comprising means for rolling a succession of sideways-moving cigarettes along a row of pins on a perforating member, and means for vibrating the pins to promote their penetration through the wrappers of the cigarettes, said pins being vibrated at a frequency which is substantially higher than the frequency at which holes are formed in each cigarette.

4. A cigarette perforating device according to claim 3 in which the pins are vibrated in a direction towards and away from the cigarettes.

5. A cigarette perforating device according to claim 4 in which the means for vibrating the pins comprises variable drive means for vibrating the pins at a variable amplitude, and in which the tips of the pins are tapered whereby the amplitude of vibration determines the depth of penetration of the pins and therefore the size of the perforations formed by the pins.

6. A cigarette perforating device according to claim 3 in which the pins are vibrated in a direction transverse to the axes thereof.

7. A cigarette perforating device acxcording to claim 3 in which the means for vibrating the pins comprises an electro magnet powered by an alternating potential.

8. A cigarette perforating device according to claim 3 in which the perforating member is mounted on a flexible member having a resonant frequency of vibration corresponding to the frequency at which the perforating member is driven for vibrating the pins.

9. A cigarette perforating device according to claim 3 in which the pins are vibrated in a direction transverse to the axes thereof.

10. A cigarette perforating device according to claim 7 in which the pins are vibrated in substantially the direction of movement of the cigarettes.

11. A cigarette perforating device comprising means for rolling a succession of sideways moving cigarettes along a row of tubular pins on a perforating member, and means for passing compressed gas through the pins and into the cigarettes to promote their penetration through the wrappers of the cigarettes.

* * * * *